United States Patent [19]

Wilson

[11] 4,304,556

[45] Dec. 8, 1981

[54] BOAT BRACKET

[76] Inventor: Larry E. Wilson, P.O. Box 218, Waynesville, Mo. 65583

[21] Appl. No.: 6,264

[22] Filed: Jan. 24, 1979

[51] Int. Cl.[3] ..... B63H 21/26

[52] U.S. Cl. ..... 440/63

[58] Field of Search ..... 9/1.1; 115/17, 18 R, 115/18 A, 34 R, 37, 41 R; 248/640, 641, 642, 643; 440/63, 53

[56] References Cited

U.S. PATENT DOCUMENTS

| | | | |
|---|---|---|---|
| 2,895,445 | 7/1959 | Foraker | 115/18 R |
| 2,899,833 | 8/1959 | Prier | 115/18 R X |
| 2,948,253 | 8/1960 | Coonrod | 248/642 X |
| 3,416,759 | 12/1968 | Arnett | 248/640 |
| 3,473,764 | 10/1969 | Hopper | 115/17 X |
| 3,505,971 | 4/1970 | Dalke | 248/642 X |
| 3,567,164 | 3/1971 | Hakala | 248/641 |
| 3,756,186 | 9/1973 | Nordling | 115/18 R |
| 3,881,443 | 5/1975 | Hamp | 248/640 X |

FOREIGN PATENT DOCUMENTS

| | | | |
|---|---|---|---|
| 1140758 | 12/1962 | Fed. Rep. of Germany | 248/640 |

*Primary Examiner*—Trygve M. Blix
*Assistant Examiner*—Jesus D. Sotelo
*Attorney, Agent, or Firm*—John D. Pope, III

[57] ABSTRACT

A bracket is provided for attaching an outdrive auxiliary motor to a motor boat. The auxiliary motor functions as a source of emergency power and the bracket enables mounting of the auxiliary motor in place without impairing the maneuverability of the boat either under its normal source of power or its auxiliary source.

3 Claims, 7 Drawing Figures

BOAT BRACKET

The present invention provides a bracket for installing an auxiliary motor which can be used as an emergency source of power.

Many types of motor boats have been provided in the past and these perform valuable and different functions depending upon their construction and the motive power provided. Occasionally, such boats have included means for substituting auxiliary power for operation in special circumstances as, for example, a fishing boat used for trolling. Where an emergency occurs, however, and the main source of motive power becomes inoperative, occupants of the boat may be shunted to manual operation of a set of oars or may find themselves adrift without means for returning to shore unless rescued.

Among the objects of the present invention is the provision of a bracket for attaching an auxiliary motor to a boat so that the auxiliary motor does not complicate normal operation of the boat, yet is easily brought into operative condition when desired; the provision of a bracket of the type indicated which permits operation of the boat under emergency conditions while preserving the customary maneuverability of the boat. Other objects and features will be in part apparent and in part pointed out hereinafter.

The invention accordingly comprises the constructions hereinafter described, the scope of the invention being indicated in the following claims.

In the accompanying drawings in which two of various possible embodiments of the invention are illustrated, FIG. 1 is perspective of a boat having an auxiliary motor mounted utilizing the bracket of the present invention;

Corresponding reference characters indicate corresponding parts throughout the several views of the drawings.

Figure 1:
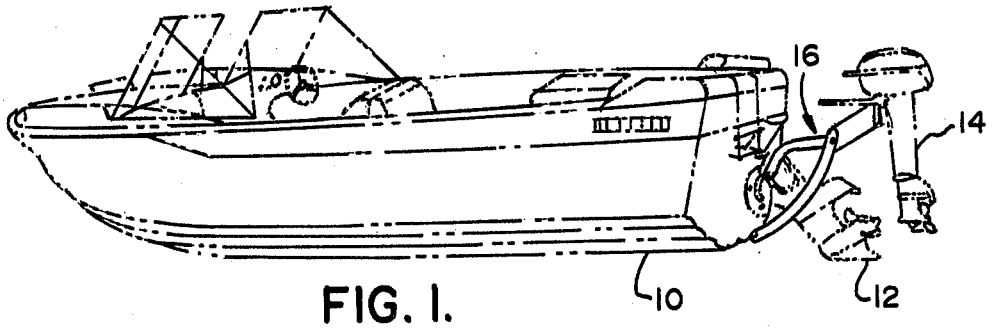

Referring now to the drawings, a boat 10 with an I/O motor drive 12 has an auxiliary motor 14 mounted to the main motor 12 by bracket 16. Bracket 16 consists of 2 pairs of arms 18–20 and 22–24. Bracket 16 is mounted to main motor 12 which is the main drive unit of the type shown in FIG. 2 by means of arms 18–20 and 22–24. Arms 18–20 are conveniently attached to main drive unit 12 through holes 27*a* and 27*b* in brackets 26 by bolts through holes 27*a* and 27*b*. Arms 18–20 are attached to brackets 26 as shown in FIG. 3 by bolt and bushing assembly 29. Arms 18–20 are attached respectively to arms 22–24 at openings 28–30 by the bolt and bushing assembly shown in FIG. 3. Support box 32 is cradled between arms 18–22 and arms 20–24 on one end so that it can support at it's opposite end auxiliary motor 14. Arms 22–24 are conveniently attached to the stern drive unit as shown in FIG. 2 through bushings 23 as shown in FIG. 3 in hole 31*a*.

Bracket 16 is perferably formed of corrosion resistant metal so that it will not rust or deteriorate from repeated and lengthy contact with bodies of water.

Figure 2:
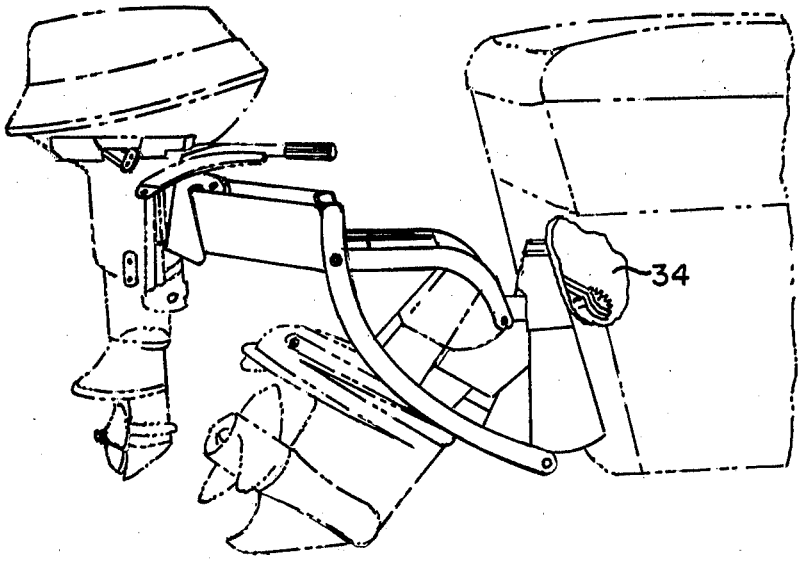
FIG. 2 is an enlarged view of the rear of the boat of FIG. 1.
Figure 3:
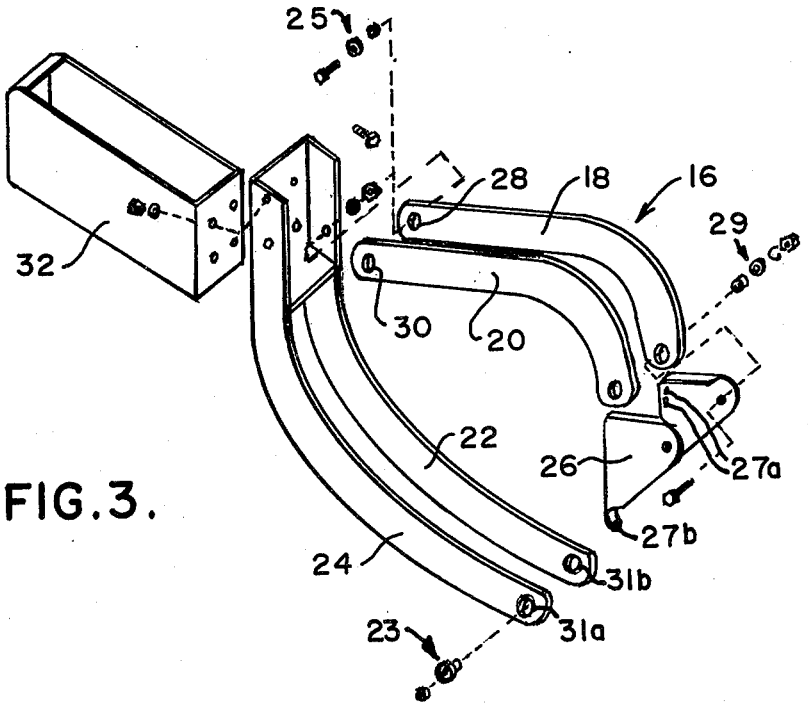
FIG. 3 is a disassembly of the bracket of the present invention showing its structure as disassembled.
Figure 5:
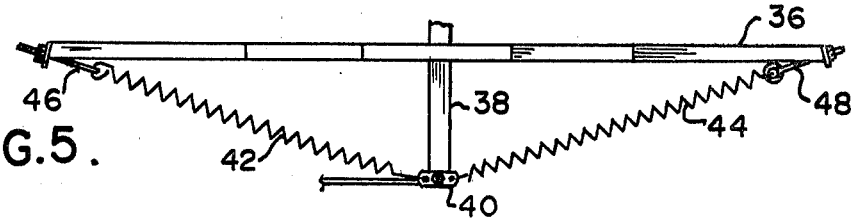
FIG. 5 is a top plan of the stern drive steering arm stabilizer bar and associated mechanism of FIG. 4.
Figure 4:
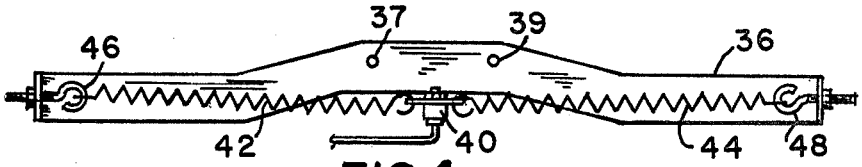
FIG. 4 is a front elevation of the stern drive steering arm of the boat to which has been mounted a stabilizer bar which facilitates maneuverability of the boat when powered by the auxiliary motor.

In FIG. 2, the transom of the boat is shown broken away at 34 to show the location of the stabilizer bar and associated springs which are attached to the stern drive steering arm and which are illustrated on an enlarged scale in FIGS. 4 and 5. Stabilizer bar 36 is located on the inside of the boat through holes 37–39 as shown in FIG. 2 and is attached to the stern drive steering arm 38 at its end 40 through springs 42–44. Springs 42–44 are thus attached to opposite sides of the boat by eye bolts 46–48. Eye bolts 46–48 permit adjusting the spring tension on stabilizer bar 36. This construction enables steering of the boat without difficulty since it renders the boat more stable than with its original equipment and eliminates side flop. With the bracket of the present invention installed as shown in FIGS. 1–2 the auxiliary motor 14 may be either raised during normal operation of the boat and lowered only when its motive power is desired without affecting the maneuverability of the boat. The main motor 12 may be raised out of the water or left in position when the auxiliary motor 14 is operated without affecting the maneuverability of the boat.

By utilizing the stabilizer bar and springs, the maneuverability of the boat is not impaired when the main motor 12 remains lowered in position but the boat is being powered by auxiliary motor 14.

The configuration of the bracket of the present invention enables it to support up to a 15 H.P. outboard motor without difficulty and therefore auxiliary motor 14 can be powerful enough to provide effective, even though slower operation of the boat than when it is under the control of main motor 12.

Figure 6:
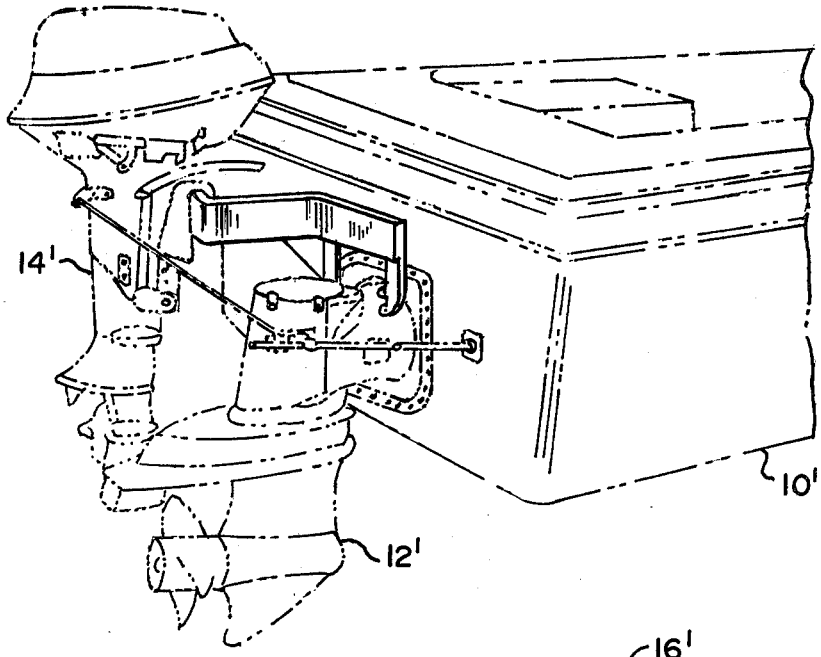
FIG. 6 is a view similar to FIG. 2 but showing an alternate form of the bracket for use with a different I/O boat.
Figure 7:
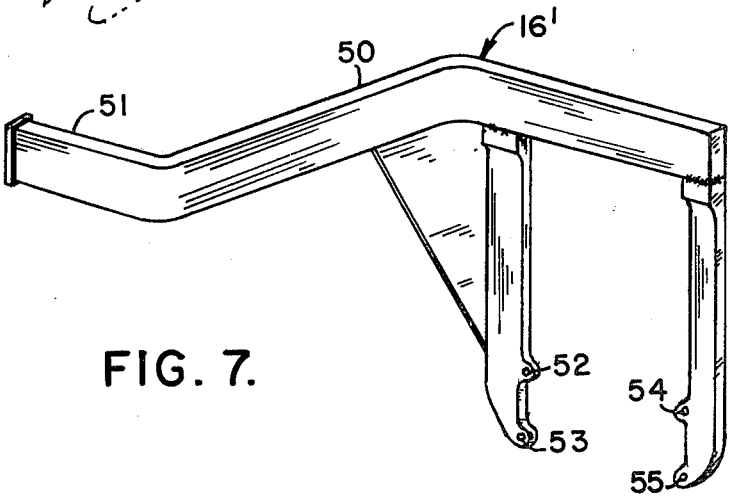
FIG. 7 is a perspective on an enlarged scale of the bracket of FIG. 6.

Turning now to FIGS. 6 and 7, an alternate form of bracket 16' is shown which is similar in purpose to bracket 16. Bracket 16' having an offset extension 50 and motor mount 51 shown in FIG. 7, enables the mounting of an auxiliary motor 14' out of line with a main motor 12' of the type shown in FIG. 6. Bracket 16' may be conveniently attached to motor 12' as shown in FIG. 6 as by bolts through holes 52 through 55 of FIG. 7. The cooperation of bracket 16' with stabilizer bar 36 and springs 42–44 similarly enables operation of boat 10' to occur without hazard when powered by auxiliary motor 14'.

Convenient as the use of the bracket of the present invention may be its importance is still greater because of its safety value. By the use of bracket 16 or 16' of the present invention and associated stabilizer bar and springs, a motor boat can be operated normally as before but when, for any reason, the main power source becomes incapacitated, the boat occupants are not left to the mercy of chance or the use of manual propulsion even where such propulsion is possible.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bracket for attaching an auxiliary motor to a boat having a main drive unit which main drive unit is pivotably movable between an up position wherein the drive unit is raised out of the water and a down position wherein the drive unit is lowered into the water, said bracket comprising:

(a) a first arm having means at one end for pivotable connection to an upper portion of the said drive unit;

(b) a second arm having at one end means for pivotable connection to a lower portion of the drive unit and means at the other end for pivotable connection to the first arm;

(c) a third arm having means at one end for pivotable connection to an upper portion of said drive unit;

(d) a fourth arm having at one end means for pivotable connection to a lower portion of the drive unit and means at the other end for pivotable connection to the third arm;

(e) said first and second arms being pivotably attached on one side of the main drive unit and forming a first arm set, said third and fourth arms being pivotably attached on the other side of the main drive unit and forming a second arm set;

(f) spacer means for separating and forming a space between the first arm set and the second arm set so that the drive unit may be raised and lowered in the space so formed;

(g) extension means for attachment to said spacer means having means for receiving the auxiliary motor so as to locate said auxiliary motor out of the path of the drive unit when it is moved from its lowered position to its raised position.

2. A bracket according to claim 1 in combination with a stabilizer bar, said stabilizer bar having means for attachment to a boat having a main drive steering arm such that each end of the bar is on an opposite side of the boat, springs attached to each end of the bar and means at the other end of the springs for attachment to the main drive steering arm of said boat.

3. A bracket according to claim 1 in which said extension means extends behind and in line with the main motor drive unit.

* * * * *